US009161622B1

(12) United States Patent
Dressendorfer et al.

(10) Patent No.: US 9,161,622 B1
(45) Date of Patent: Oct. 20, 2015

(54) AIR TRAFFIC CONTROL CENTER CONSOLE

(71) Applicants: Michael Dressendorfer, San Dimas, CA (US); Trevor Simon, Lake Forest, CA (US); Sasha Johnson, Fullerton, CA (US); Ott Bouasry, Anaheim, CA (US); Bernard A. Higuera, Chino Hills, CA (US)

(72) Inventors: Michael Dressendorfer, San Dimas, CA (US); Trevor Simon, Lake Forest, CA (US); Sasha Johnson, Fullerton, CA (US); Ott Bouasry, Anaheim, CA (US); Bernard A. Higuera, Chino Hills, CA (US)

(73) Assignee: RUSS BASSETT CORPORATION, Whitter, CA (US)

( * ) Notice: Subject to any disclaimer, the term of this patent is extended or adjusted under 35 U.S.C. 154(b) by 0 days.

(21) Appl. No.: 14/326,728

(22) Filed: Jul. 9, 2014

(51) Int. Cl.
*A47B 81/00* (2006.01)
*A47B 83/00* (2006.01)
*A47B 81/06* (2006.01)

(52) U.S. Cl.
CPC ..... *A47B 83/001* (2013.01); *A47B 81/061* (2013.01); *A47B 2200/0078* (2013.01)

(58) Field of Classification Search
CPC ..... A47B 2021/066; A47B 2021/068; A47B 2037/005; A47B 2200/0013; A47B 2200/008; A47B 2200/0081; A47B 2200/0082; A47B 2200/0076; A47B 2200/0078; A47B 83/001; A47B 21/0314
See application file for complete search history.

(56) References Cited

U.S. PATENT DOCUMENTS

| | | | | | |
|---|---|---|---|---|---|
| 5,975,657 | A * | 11/1999 | LaCour | 312/196 |
| 5,988,076 | A * | 11/1999 | Vander Park | 108/50.02 |
| 6,152,048 | A * | 11/2000 | Vander Park | 108/50.02 |
| 6,382,747 | B1 * | 5/2002 | Catta et al. | 312/257.1 |
| 6,990,909 | B2 * | 1/2006 | Gosling et al. | 108/50.02 |
| 8,393,585 | B2 | 3/2013 | Han et al. | |
| 2002/0171015 | A1 * | 11/2002 | Gosling | 248/125.2 |
| 2003/0070377 | A1 * | 4/2003 | Waalkes et al. | 52/481.2 |
| 2003/0154673 | A1 * | 8/2003 | MacGregor et al. | 52/239 |
| 2005/0162051 | A1 * | 7/2005 | Madsen et al. | 312/287 |
| 2009/0293391 | A1 * | 12/2009 | DeVore | 52/239 |
| 2011/0001406 | A1 * | 1/2011 | Han et al. | 312/236 |
| 2011/0197519 | A1 * | 8/2011 | Henriott et al. | 52/36.1 |
| 2012/0311937 | A1 * | 12/2012 | Parshad et al. | 52/36.1 |

* cited by examiner

*Primary Examiner* — Hanh V Tran
(74) *Attorney, Agent, or Firm* — Kenneth L. Green; Averill & Green

(57) ABSTRACT

An Air Traffic Control (ATC) console provides improved structural integrity and cable routing. The ATC console includes laterally spaced apart vertical ribs including a strong center box structure and slat wall hooks on opposing flat wings. Front and rear slat wall panels attached to opposite sides of the ribs by horizontal lips on rear surfaces of the slat walls engaging the slat wall hooks. Horizontal openings for cable passage are created by spacing consecutive slat walls apart, and may be staggered to avoid light reaching an operator. Brush grommets may fill the openings in the front slat walls further preventing light from reaching the operator. Cable trays may be position under the horizontal openings and the vertical ribs may include cable pass throughs aligned with the horizontal openings and cable trays allowing cables to be routed laterally between the slat walls.

18 Claims, 8 Drawing Sheets

AIR TRAFFIC CONTROL CENTER CONSOLE

BACKGROUND OF THE INVENTION

The present invention relates to Air Traffic Control (ATC) centers and in particular to consoles providing work stations for air traffic controllers.

Due to the very large number of commercial flights to and from large airports, controlling aircraft traffic has become essential to safety. Air traffic controllers must monitor traffic into and out of airports and ensure that aircraft maintain safe separation. The tasks of the air traffic controllers can easily become extremely stressful and it is essential that an environment is provided which facilitates their ability to concentrate on their work and be free from distractions. The work stations provided for the air traffic controllers must therefore provide reliability and maintainability in addition to a suitable environment. Equipment presently in use has aged to point where maintenance is very expensive and often difficult. There is thus a need for replacement ATC consoles providing improved environment, reliability, and maintainability.

Current Federal Aviation Administration (FAA) ATC consoles are rigid welded steel consoles designed to position specific equipment around users. The known ATC consoles are built from the floor to the soffit to block light from the rear service aisle because the users like a dark environment required with radar scopes. The radar scopes came in a very large enclosure, originally sized large enough to fit the old radar monitor with tubes, and the enclosures needed to be removable from the back side. As a result, the service aisle behind the known ATC consoles is quite large, for example, six to eight feet deep. The known ATC consoles were also very deep and the equipment was mounted at the front on angled faces for easy operator access, but which makes servicing the equipment very difficult for the technicians on the back side.

Further, known ATC consoles have large swinging doors reaching across, or nearly across, an aisle behind the consoles. When two technicians are working together to remove equipment, the swinging doors present a significant obstacle to movement behind the consoles.

For decades, the known ATC consoles went through minor changes, but in recent years, more significant changes have started to take place as technology gets more advanced. Updating equipment in the current ATC consoles requires covering old equipment holes and cut new holes to fit the new equipment in these rigid steel ATC consoles. As a result, there is no flexibility with respect to where equipment is located, the amount of ATC console space allocated to each piece of equipment, ergonomic adjustments, etc.

The FAA recognized that other customers of console furniture no longer use rigid welded consoles, but rather use slatwall consoles which have equipment mounts which allow the equipment to be attached over a range of locations on the slatwall allowing ergonomic equipment positioning for the operators. The FAA has been working for a long time on a next generation system which will replace much of the existing equipment with smaller, lighter computer driven solutions resolving these issues and providing desired advantages. Such next generation consoles require development to meet the needs of the FAA.

BRIEF SUMMARY OF THE INVENTION

The present invention addresses the above and other needs by providing an Air Traffic Control (ATC) console which provides improved structural integrity and cable routing. The ATC console includes laterally spaced apart vertical ribs including a strong center box structure and slat wall hooks on opposing flat wings. Front and rear slat wall panels attached to opposite sides of the ribs by horizontal lips on rear surfaces of the slat walls engaging the slat wall hooks. Horizontal openings for cable passage are created by spacing consecutive slat walls apart, and may be staggered to avoid light reaching an operator. Brush grommets may fill the openings in the front slat walls further preventing light from reaching the operator. Cable trays may be position under the horizontal openings and the vertical ribs may include cable pass throughs aligned with the horizontal openings and cable trays allowing cables to be routed laterally between the slat walls.

In accordance with one aspect of the invention, there is provided an ATC console including vertical ribs having slat wall hooks for attaching slat walls. The vertical ribs include front and rear flat wings, the slat wall hooks on opposite edges of the flat wings. The vertical ribs have center box structures for strength and are constructed from two mirror image metal forms attached together. The combination of two metal forms to make vertical ribs with the center box structures allows using thin material which reduces cost while avoiding twisting. Because the slat walls engage the slat wall hooks, the vertical ribs may be horizontally spaced as needed to support the slat walls, and as many vertical ribs as required In accordance with another aspect of the invention, there is provided an ATC console including vertically spaced apart horizontal openings allowing cables to pass through the slat walls while restricting the passage of light. Front brush grommets are attached to the front slat walls covering front horizontal openings to block the passage of light through the front slat walls. The front brush grommets are preferably attached to the front slat walls along top edges of the front brush grommets. Rear horizontal openings in the rear slat wall are positioned slightly lower than corresponding front brush grommets to further reduce or prevent light from passing through the slat walls, and bottom of the front brush grommets may be about even with tops of the rear horizontal openings. Cable chutes on right and left ends of the slat walls provide addition cable routing options. Cable trays preferably reside just below bottom edges of the front brush grommets to support laterally running cables. Additionally, rear brush grommets may cover the rear horizontal openings to further limit light passage.

In accordance with yet another aspect of the invention, there are provided ATC consoles including a vertically closing tambour doors. Known ATC consoles have large swinging doors allowing removal of the radar screens and require a large rear aisle. The swinging doors require a large space in the rear aisle to open into. Replacing the swinging doors with tambour doors eliminates the space required in rear service aisle for opening the door, allowing reduced rear service aisle size. This reduction allows the consoles to be moved closer to the walls allowing the operator area to expand, increasing operator area of existing TRACON buildings. As the air traffic congestion continues to rise and more operators are needed, the increase in operator area provided by the tambour doors allows adding operators to existing buildings. Because the tambour doors do not intrude into the service areas behind the ATC consoles, maintenance workers can move freely through the service areas during maintenance. Grounding brushes reside along vertical door tracks to prevent shocks.

In accordance with still another aspect of the invention, there is provided an ATC console including sucker fans at the base of the ATC console. The fans provide air circulation through the ATC console interior.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
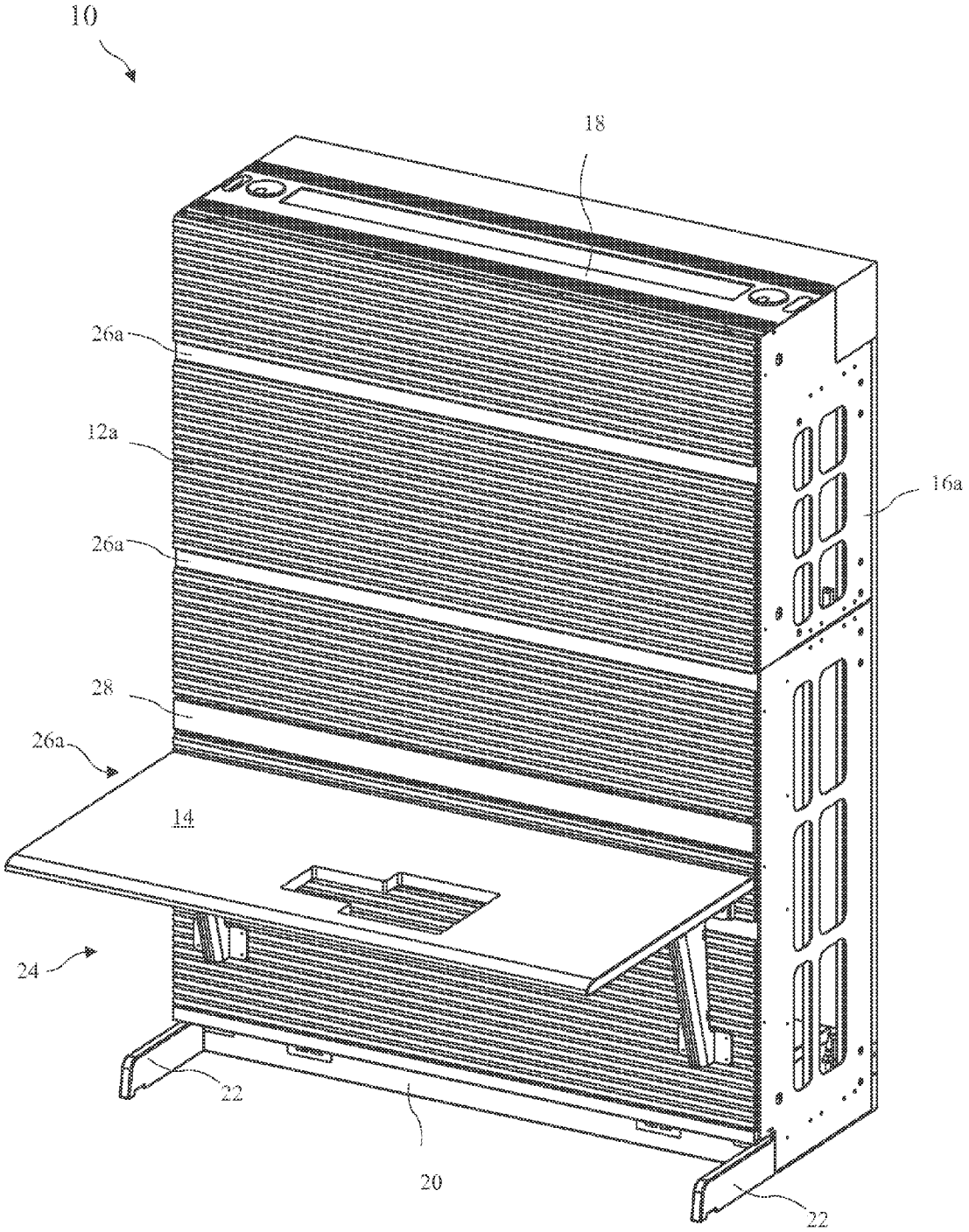
FIG. 1 is a front perspective view of an Air Traffic Control (ATC) console according to the present invention.
Figure 2:
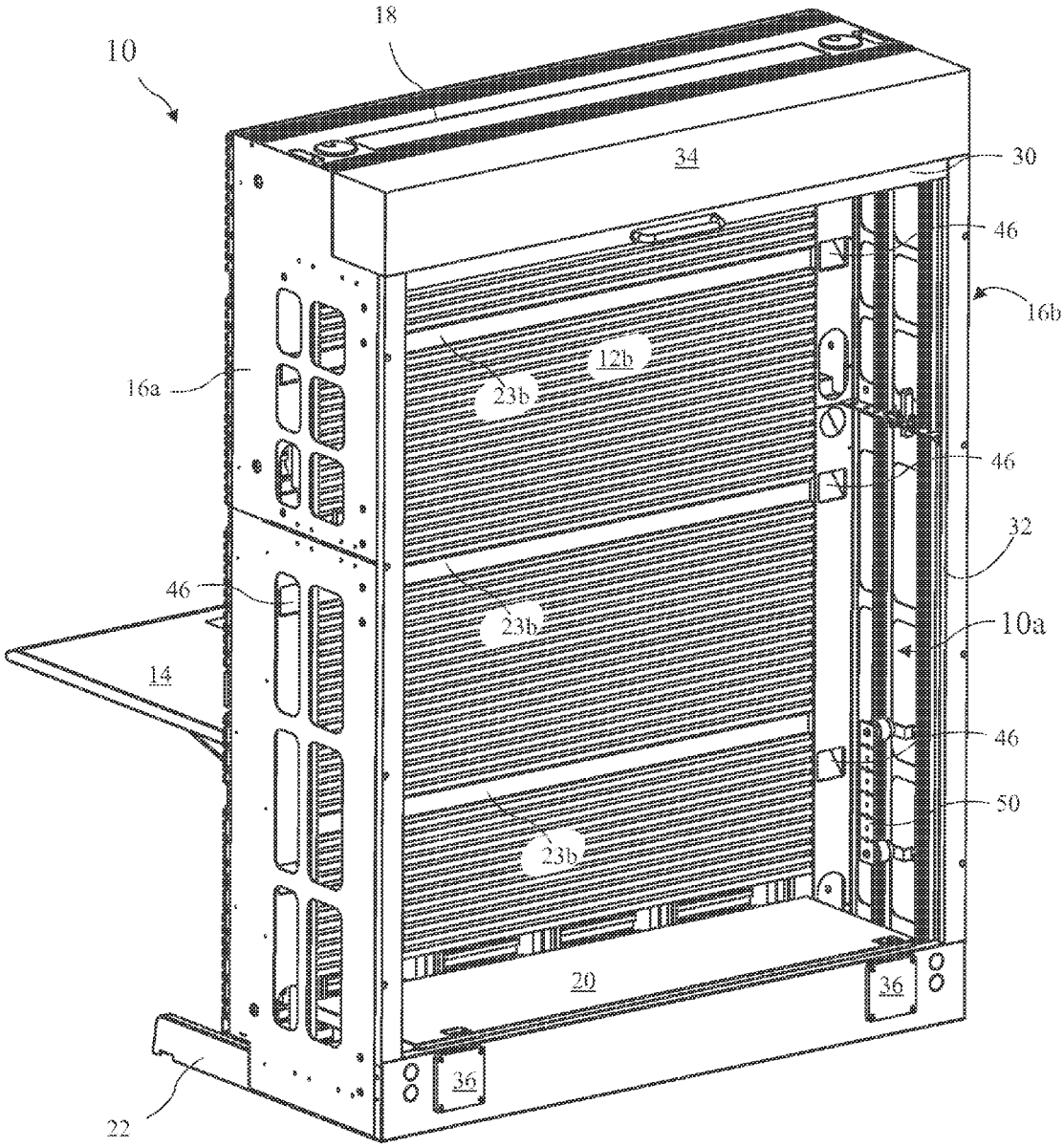
FIG. 2 is a rear perspective view of the ATC console according to the present invention.
Figure 3:
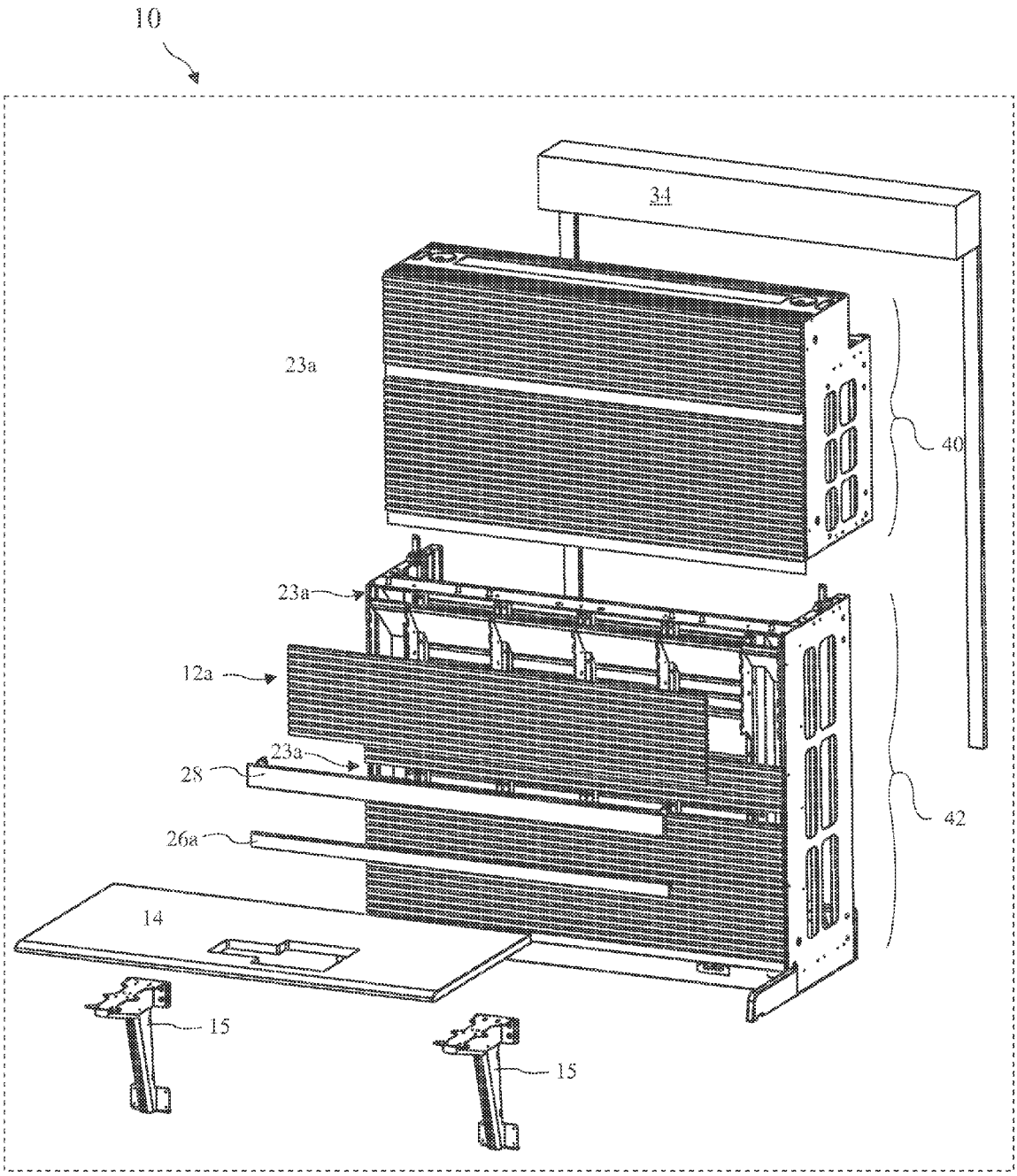
FIG. 3 is an exploded view of the ATC console according to the present invention.

A front perspective view of an Air Traffic Control (ATC) console 10 according to the present invention is shown in FIG. 1, a rear perspective view of the ATC console 10 is shown in FIG. 2, and an exploded view of the ATC console 10 is shown in FIG. 3. The ATC console 10 includes front and rear slat walls 12*a* and 12*b*. The front slat wall 12*a* resides forward facing an operator position 24 for mounting monitors and the like, and the rear slat wall 12*b* resides rearward facing inside the ATC console interior 10*a* for attachment of equipment supporting operation of the ATC console 10. A table 14 reached forward from the front slat wall 12*a* for use by an operator. Sides 16*a* and 16*b* enclose the interior 10*a* and a top 18 and bottom 20 provide structural support to the ATC console 10. Front brush grommets 26*a* reside in the front slat wall 12*a* allowing cables to pass through the front slat wall 12*a* and rear horizontal openings 23*b* reside in the rear slat wall 12*b* allowing cables to pass through the rear slat wall 12*b*. A flipper plate 28 resides in the front slat wall 12*a* slightly above the table 14 allowing additional cables to pass through the front slat wall 12*a*.

A tambour door assembly 34 includes a vertically closing tambour door 30 and ground brushes 32 along right and left vertical tracks for grounding the tambour door 30. The rear horizontal opening 23*b* are generally vertically aligned with the front brush grommets 26*a* to facilitate passing cables through the front brush grommet 26*a* and rearward through the corresponding rear brush grommet 26*b*. Cable chutes 46 reside inside the ATC console interior 10*a* on each end of the rear slat wall 12*b*, generally vertically aligned with the rear horizontal openings 23*b*. Cable may thus be routed into the front brush grommets 26*a*, and right or left to the cable chutes 48. A ground bar 50 is electrically connected to the ATC console 10 and resides in the ATC console interior 10*a* providing a ground for electrical equipment residing in the ATC console interior 10*a*. Sucker fans 36 reside proximal to the bottom 20 and draw ambient air into the ATC console interior 10*a* and braces 15 support the table 14.

Figure 5:
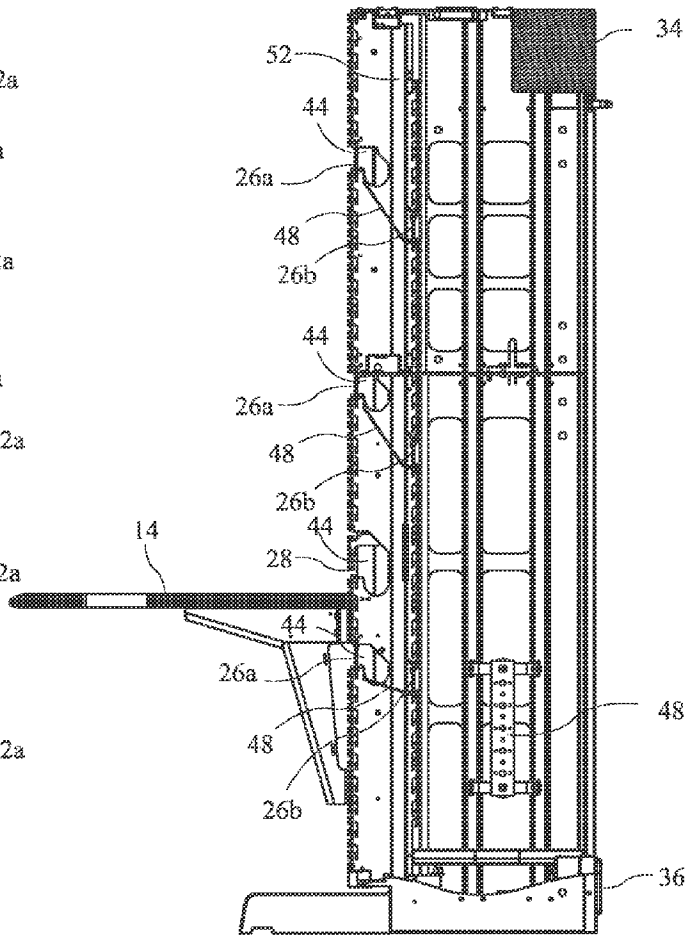
FIG. 5 is a cross-sectional view of the ATC console according to the present invention taken along line 5-5 of FIG. 4.
Figure 4:
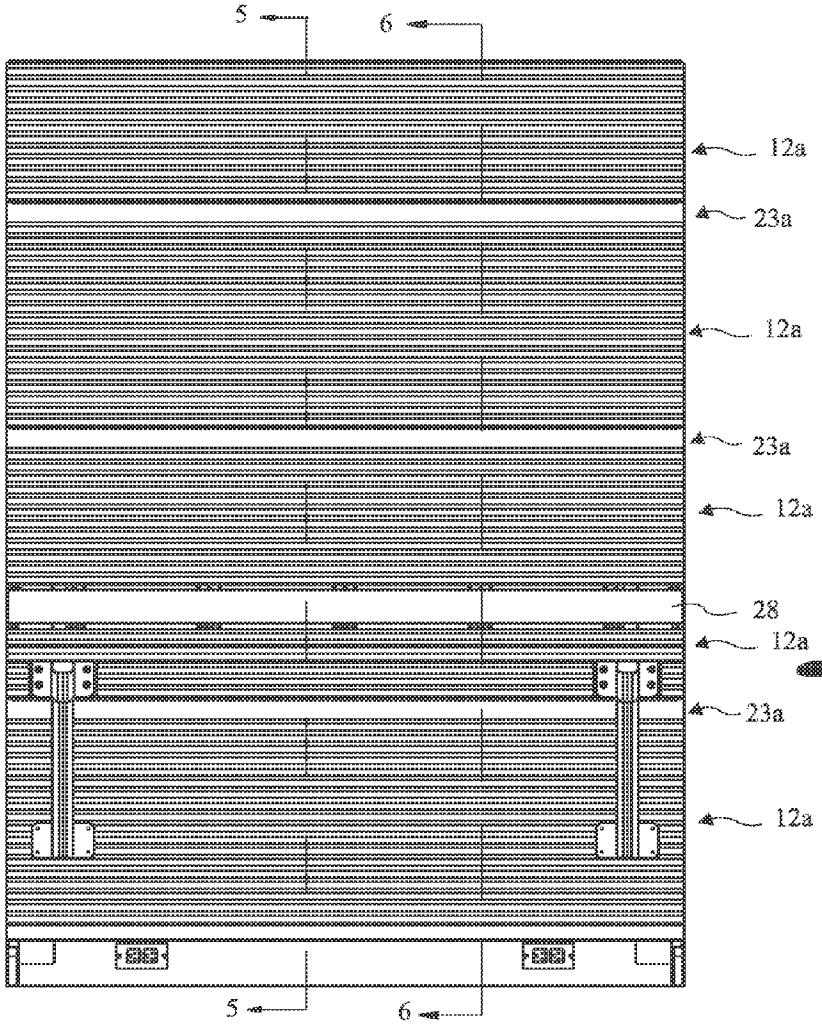
FIG. 4 is a front of the ATC console according to the present invention.
Figure 6:
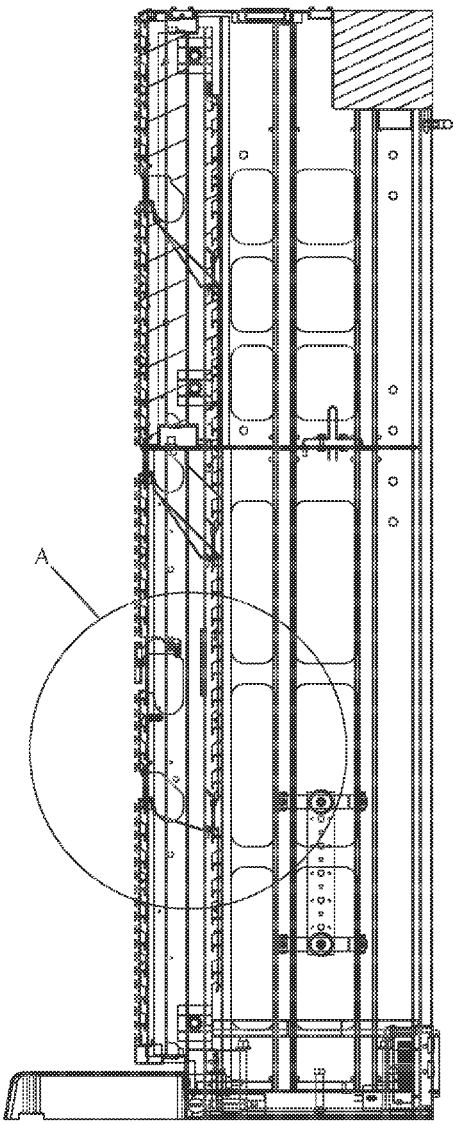
FIG. 6 is a cross-sectional view of the ATC console according to the present invention taken along line 6-6 of FIG. 4.

A front of the ATC console 10 is shown in FIG. 4, a cross-sectional view of the ATC console 10 taken along line 5-5 of FIG. 4 is shown in FIG. 5, and a cross-sectional view of the ATC console 10 taken along line 6-6 of FIG. 4 is shown in FIG. 6. Cable pass throughs 44 in vertical ribs 52 reside behind the front brush grommets 26*a*, allowing cables to be inserted through the brush grommets 26*a* and laterally between the front brush grommets 26*a* and rear grommets 26*b*. Cable trays 48 reside under the cable pass throughs 44 to provide a surface to the cables to rest on. Additional cable pass throughs 44 reside behind the flipper plate 28.

Figure 7:
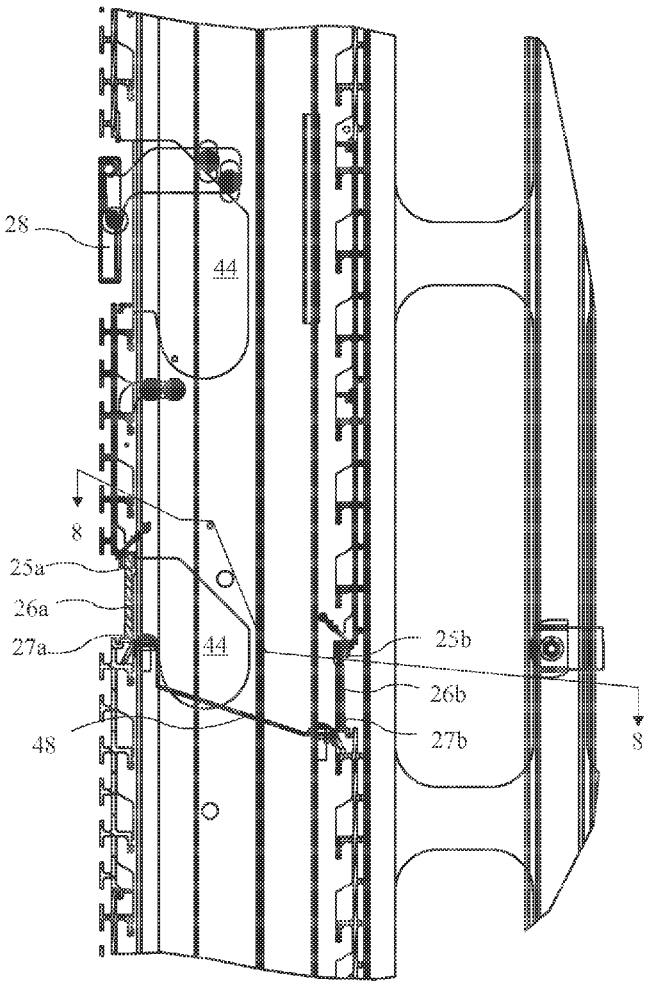
FIG. 7 is an expanded view of detail A of FIG. 6.

An expanded view of detail A of FIG. 6 is shown in FIG. 7. The front brush grommets 26*a* are preferably offset above rear brush grommets 26*b*, and more preferably the bottom edges 27*a* of the front brush grommets 26*a* are about vertically aligned with top edges 25*b* of the rear brush grommets 26*b*. The bushings 26*a* and 26*b* are attached at grommet tops 25*a* and 25*b* respectively and bushing bottoms 27*a* and 27*b* separate forming an inverted "V" when cables pass through the grommet 26*a* and 26*b*. In one embodiment, the rear brush grommets 26*b* are omitted.

Figure 8:
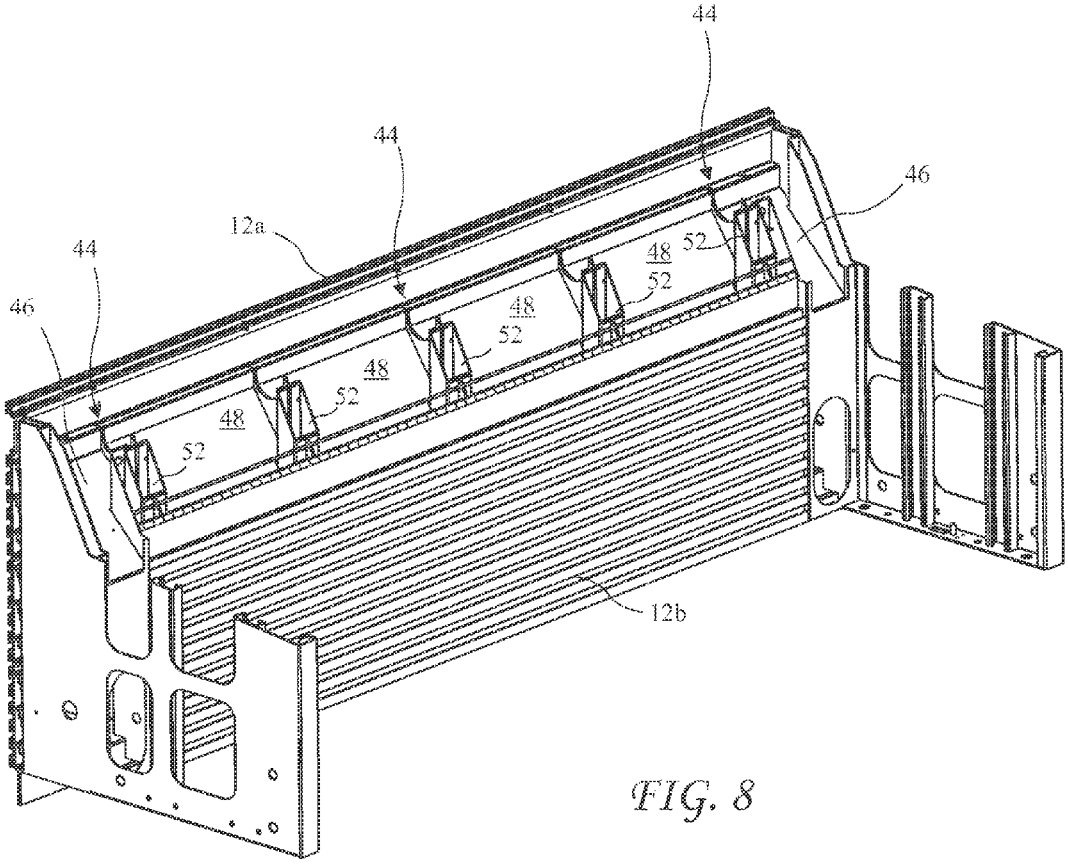
FIG. 8 is a cross-sectional view of the ATC console according to the present invention taken along line 8-8 of FIG. 7.

A cross-sectional view of the ATC console 10 taken along line 8-8 of FIG. 7 is shown in FIG. 8. Cable pass throughs 44 are present between the cable chutes 46 and adjacent spaced between the front brush grommets 26*a* and rear brush grommets 26*b* allowing cables to be inserted through either the front brush grommets 26*a* and rear brush grommets 26*b* and to the cable chutes 46.

Figure 9B:
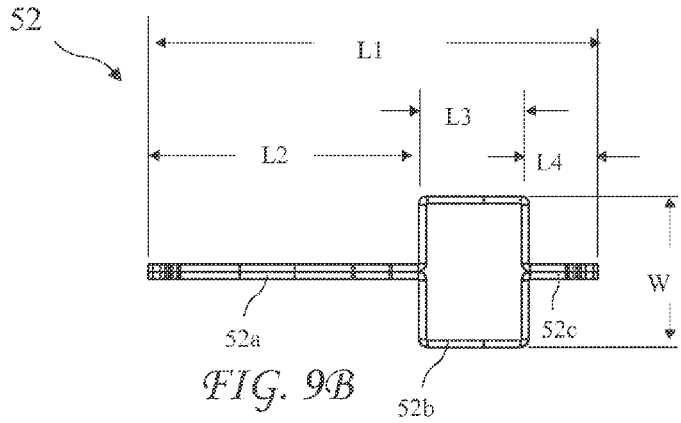
FIG. 9B is a top view of the vertical rib of the ATC console according to the present invention.
Figure 9A:
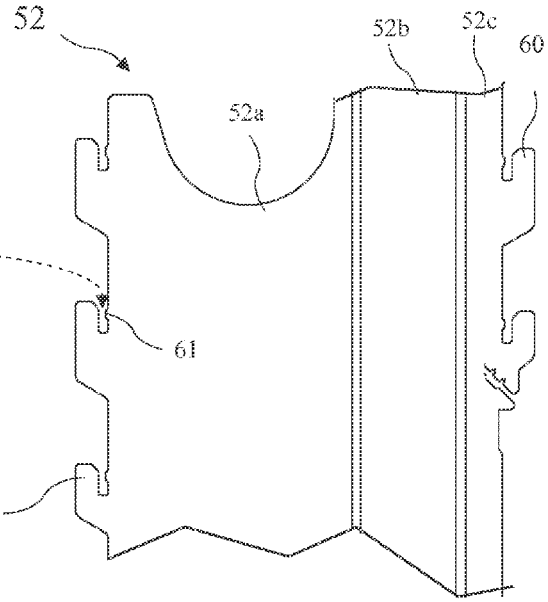
FIG. 9A is a side view of a portion of a vertical rib of the ATC console according to the present invention.

A side view of a portion of a vertical rib 52 of the ATC console 10 is shown in FIG. 9A and a top view of the vertical rib 52 is shown in FIG. 9B. The vertical ribs 52 includes a flat front wing portion 52*a*, and center boxed portion 52*b* and a flat rear wing portion 52*c*. The vertical rib 52 has a length L1, the flat front wing portion 52*a* has a length L2 and the flat rear wing portion 52*b* has a length L4. The center box portion has a length L3 and a width W. The length L1 is preferably about 5.625 inches, the length L2 is about 2.75 inches, the length L3 is about 1.12 inches, the length L4 is about 0.7 inches, and the width W is about 1.56 inches. Front slat board hooks 54*a* are on a front edge of the flat front wing portion 52*a* and rear slat board hooks 54*b* are on a rear edge of the flat rear wing portion 52*b*.

Figure 10:
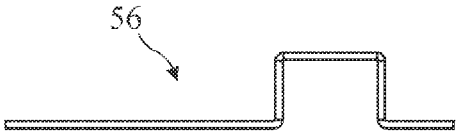
FIG. 10 is a cross-sectional view of a slat wall according to the present invention.

A cross-sectional view of the slat wall 12*a* is shown in FIG. 10. The slat walls 12*a* and 12*b* are preferably extrusions with a constant cross-section over the length of the slat wall and an outer face 12' facing the operator and an inner face 12" facing away from the operator. The vertical rib 52 includes vertically spaced apart hooks 60 on both the flat front and rear wing portions 52*a* and 52*b*. The slat walls 12*a* and 12*b* include horizontal engaging lips 62 running the length of the inner face of 12", which lips 62 engage the hooks 60 to secure the slat walls 12*a* and 12*b* to the vertical ribs 52. A small bump 61 in the hook 60 may be provided for an interference fit of the lips 62. The hooks 60 are preferably spaced apart about two inches to provide good support to the slat walls 12*a* and 12*b*, and each of the slat walls 12*a* and 12*b* preferably include at least three lips 62 which engage three hooks 60 to allow the slat walls to carry planned equipment. Preferably, the slat walls 12*a* and 12*b* are not held laterally (other than by an interference fit) by the vertical ribs 52 and are held laterally by the side 16*a* and 16*b* (see FIG. 2).

Because the lips 62 are continuous, the lateral spacing of the vertical ribs 52 may be selected for different applications. A preferred lateral spacing of the vertical ribs is about twelve inches for the ATC console 10. The ability to select the lateral spacing of the vertical ribs 52 and the number of the vertical ribs 52 allows the ATC console 10 to be made in any useful length, thus not limiting the size of each ATC console.

The slat walls 12*a* and 12*b* include slats 70 for attachment of operator devices, and tongues 66 and grooves 64 for mating consecutive slat walls. A notch 68 is provided in the bottom of the slats walls 12*a* and 12*b* for attachment of the brush grommets 26*a* and 26*b*. The slats 70 are preferably spaced about one inch apart. The slat walls 12*a* and 12*b* are preferably made in about six inch high sections.

Figure 11:
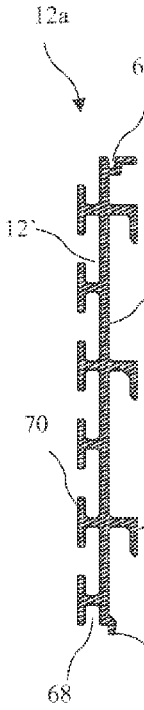
FIG. 11 is a top view of a metal form used in constructing the vertical rib of the ATC console according to the present invention.

A top view of a metal form 56 used in constructing the vertical ribs 52 is shown in FIG. 11. The metal form 56 is attached to a mirror image metal form to construct the vertical ribs 52.

Figure 12:
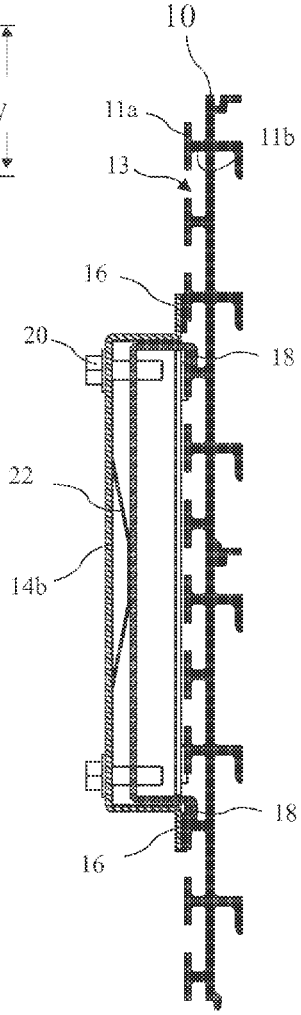
FIG. 12 is a cross-sectional view of a controlled stress hanger according to the present invention.
Figure 13:
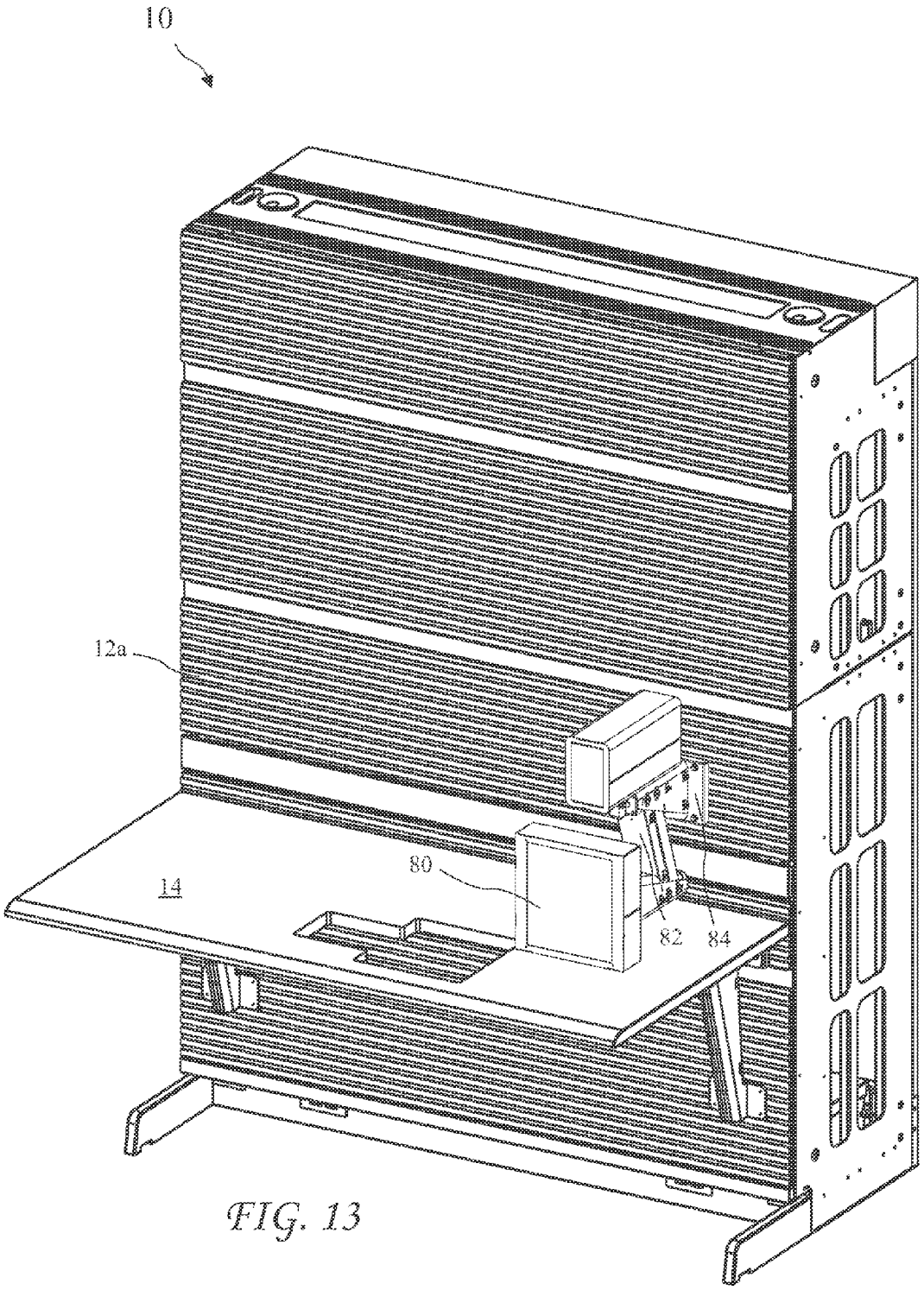
FIG. 13 shows a Touch Entry Display (TED) mounted to the ATC console according to the present invention using the controlled stress hanger.

A cross-sectional view of a controlled stress hanger 84 is shown in FIG. 12, and a Touch Entry Display (TED) 80 is shown mounted to the ATC console 10 using a TED mount 82 and controlled stress hanger 84 in FIG. 13. The controlled stress hanger 84 and TED mount 82 are described in detail in U.S. patent application Ser. No. 14/058,235 filed 19 Oct., 2013 by the present inventors. The '235 application is herein incorporated by reference in its entirety.

While the invention herein disclosed has been described by means of specific embodiments and applications thereof, numerous modifications and variations could be made thereto by those skilled in the art without departing from the scope of the invention set forth in the claims.

We claim:

1. An Air Traffic Control (ATC) console comprising;

a multiplicity of laterally spaced apart vertical ribs, each rib comprising:

a center box structure providing strength;

a front wing reaching forward from the center box structure and including front slat wall hooks on a forward edge;

a rear wing reaching rearward from the center box structure and including rear slat wall hooks on a rearward edge;

a front slat wall having an outer face facing towards an air traffic controller position and having horizontal slats configured for mounting operator equipment, and an inner face having lips engaging the front slat wall hooks;

a rear slat wall having a second outer face facing away from an air traffic controller position and having second slats configured for mounting support equipment, and a second inner face having lips engaging the rear slat wall hooks;

a right side attached to a right side of the ATC console;

a left side attached to a left side of the ATC console;

a rear opening allowing access to equipment in the ATC console interior;

a horizontal base supporting the ATC console;

a horizontal top attached to tops of the vertical ribs; and a work table for the an operator, the work table attached to the front slat wall and extending into the air traffic controller position.

2. The ATC of claim 1, wherein the slat wall hooks on the front wing and the rear wings are vertically spaced apart by about two inches.

3. The ATC of claim 1, wherein at least three lips on each slat wall section engage the slat wall hooks.

4. The ATC of claim 1, wherein the slats are vertically spaced apart by about one inch.

5. The ATC of claim 1, wherein the center box structures of the vertical ribs are laterally offset to provide a wider one of the front wings and the rear wings.

6. The ATC of claim 5, wherein the center box structures of the vertical ribs are laterally offset towards the rear of the ATC console.

7. The ATC of claim 5, wherein the vertical ribs are constructed by joining two metal form halves, each half including one layer of each wing and one side of the center box.

8. The ATC of claim 5, wherein the slat walls include at least one brush grommet providing for passage of cables while reducing or preventing light from passing through the ATC console.

9. The ATC of claim 8, wherein the vertical ribs include cable pass throughs in one of the front wings and the rear wings and generally vertically aligned with the brush grommets allowing lateral cable routing.

10. The ATC of claim 9, wherein cable trays reside under the cable pass throughs and support laterally routed cables.

11. The ATC of claim 1, wherein the front slat wall includes at least one front brush grommet and the rear slat wall includes at least one rear brush grommet generally vertically aligned with the front brush grommet providing for passage of cables through both the front slat wall and through the rear slat wall while reducing or preventing light from passing through the ATC console.

12. The ATC of claim 11, wherein front brush grommets in the front slat wall facing the air traffic controller position are offset above rear brush grommets in the rear slat wall facing away from the air traffic controller position.

13. The ATC of claim 12, wherein bottom edges of the front brush grommets are about vertically aligned with top edges of the rear brush grommets.

14. The ATC of claim 1, further including a vertically closing tambour door lowerable to close a rear opening of the ATC console.

15. The ATC of claim 14, further including grounding brushes along each vertical edge of the rear opening, the grounding brushes making contact with the tambour door.

16. The ATC of claim 1, further including at least one sucker fan at a base of the rear opening to draw ambient air into the ATC to cool the interior.

17. An Air Traffic Control (ATC) console comprising;

a multiplicity of laterally spaced apart vertical ribs constructed by joining two metal form halves, each rib comprising:

a center box structure offset towards the rear of the ATC console, providing strength, each vertical rib half including one side of the center box structure;

a front wing reaching forward from the center box structure and including front slat wall hooks on a forward edge; and a rear wing reaching rearward from the center box structure and including rear slat wall hooks on a rearward edge, each vertical rib half including one layer of each wing;

a front slat wall having an outer face facing towards an air traffic controller position and having horizontal slats configured for mounting operator equipment, and an inner face having lips engaging the front slat wall hooks;

a rear slat wall having a second outer face facing away from an air traffic controller position and having second slats configured for mounting support equipment, and a second inner face having lips engaging the rear slat wall hooks;

brush grommets the front slat walls providing for passage of cables while reducing or preventing light from passing through the ATC console;

cable pass throughs in the front wings generally vertically aligned with the brush grommets allowing lateral cable routing;

cable trays reside under the cable pass throughs and support laterally routed cables;

a right side attached to a right side of the ATC console;

a left side attached to a left side of the ATC console;

a rear opening allowing access to equipment in the ATC console interior;

a horizontal base supporting the ATC console;

a horizontal top attached to tops of the vertical ribs;

a work table for the an operator, the work table attached to the front slat wall and extending into the air traffic controller position; and a vertically closing tambour door lowerable to close a rear opening of the ATC console, wherein the vertical ribs include cable pass throughs in one of the front wings and the rear wings and generally vertically aligned with the brush grommets allowing lateral cable routing.

18. An Air Traffic Control (ATC) console comprising;

a multiplicity of laterally spaced apart vertical ribs constructed by joining two metal form halves, each rib comprising:

a center box structure offset towards the rear of the ATC console, providing strength, each vertical rib half including one side of the center box structure;

a front wing reaching forward from the center box structure and including front slat wall hooks vertically spaced apart by about two inches on a forward edge; and a rear wing reaching rearward from the center box structure and including rear slat wall hooks on a rearward edge, each vertical rib half including one layer of each wing;

a front slat wall having an outer face facing towards an air traffic controller position and having horizontal slats vertically spaced apart by about one inch and configured for mounting operator equipment, and an inner face having lips engaging the front slat wall hooks;

a rear slat wall having a second outer face facing away from an air traffic controller position and having second slats vertically spaced apart by about one inch and configured for mounting support equipment, and a second inner face having lips engaging the rear slat wall hooks;

brush grommets the front slat walls providing for passage of cables while reducing or preventing light from passing through the ATC console;

cable pass throughs in the front wings generally vertically aligned with the brush grommets allowing lateral cable routing;

cable trays reside under the cable pass throughs and support laterally routed cables;

a right side attached to a right side of the ATC console;

a left side attached to a left side of the ATC console;

a rear opening allowing access to equipment in the ATC console interior;

a horizontal base supporting the ATC console;

a horizontal top attached to tops of the vertical ribs;

a work table for the an operator, the work table attached to the front slat wall and extending into the air traffic controller position; and a vertically closing tambour door lowerable to close a rear opening of the ATC console, wherein the vertical ribs include cable pass throughs in one of the front wings and the rear wings and generally vertically aligned with the brush grommets allowing lateral cable routing.

* * * * *